US010103835B2

(12) United States Patent
Morrow et al.

(10) Patent No.: US 10,103,835 B2
(45) Date of Patent: Oct. 16, 2018

(54) PORTABLE COUNTERMEASURE DEVICE AGAINST UNMANNED SYSTEMS

(71) Applicant: Battelle Memorial Institute, Columbus, OH (US)

(72) Inventors: Alexander Morrow, Gahanna, OH (US); Daniel E. Stamm, Columbus, OH (US); Raphael Joseph Welsh, Powell, OH (US)

(73) Assignee: BATTELLE MEMORIAL INSTITUTE, Columbus, OH (US)

( * ) Notice: Subject to any disclaimer, the term of this patent is extended or adjusted under 35 U.S.C. 154(b) by 0 days.

(21) Appl. No.: 15/274,021

(22) Filed: Sep. 23, 2016

(65) Prior Publication Data

US 2017/0237520 A1 Aug. 17, 2017

Related U.S. Application Data

(60) Provisional application No. 62/222,475, filed on Sep. 23, 2015.

(51) Int. Cl.
*H04K 3/00* (2006.01)

(52) U.S. Cl.
CPC ..... *H04K 3/825* (2013.01); *H04K 3/65* (2013.01); *H04K 3/41* (2013.01); *H04K 2203/22* (2013.01); *H04K 2203/32* (2013.01)

(58) Field of Classification Search
CPC ..... H04K 2203/32; H04K 3/41
USPC ..... 455/1, 67.11, 522, 63.1, 67.13
See application file for complete search history.

(56) References Cited

U.S. PATENT DOCUMENTS

| | | | |
|---|---|---|---|
| 4,584,578 | A | 4/1986 | Brauns et al. |
| 5,001,771 | A | 3/1991 | New |
| 5,287,110 | A | 2/1994 | Tran |
| 5,822,429 | A | 10/1998 | Casabona et al. |
| 5,896,105 | A | 4/1999 | Murphy et al. |
| 6,396,432 | B1 | 5/2002 | Riemschneider et al. |
| 6,480,144 | B1 * | 11/2002 | Miller ..... B60R 21/013 180/167 |
| 6,977,598 | B2 | 12/2005 | Longbottom |
| 7,050,755 | B2 | 5/2006 | Kline |
| 7,099,369 | B2 | 8/2006 | Karlsson |

(Continued)

FOREIGN PATENT DOCUMENTS

WO WO 2017/053693 3/2017

OTHER PUBLICATIONS

International Search Report and Written Opinion for International Application No. PCT/US2016/053291, dated Dec. 20, 2016.

(Continued)

*Primary Examiner* — John J Lee
(74) *Attorney, Agent, or Firm* — Fay Sharpe LLP

(57) ABSTRACT

A portable countermeasure device is provided comprising one or more directional antennae, one or more disruption components and at least one activator. The portable countermeasure device further comprises a body, with the directional antennae are affixed to a front portion of the body. The one or more disruption components may be externally or internally mounted to the device body. The portable countermeasure device is aimed at a specific drone, the activator is engaged, and disruptive signals are directed toward the drone, disrupting the control, navigation, and other signals to and from the drone.

18 Claims, 9 Drawing Sheets

(56) References Cited

U.S. PATENT DOCUMENTS

| | | | | |
|---|---|---|---|---|
| 7,318,368 | B2 | 1/2008 | Ham et al. | |
| 7,423,575 | B2 | 9/2008 | Duff et al. | |
| 7,489,264 | B2 | 2/2009 | Ferm et al. | |
| 7,554,481 | B2 | 6/2009 | Cohen et al. | |
| 7,574,168 | B2 | 8/2009 | Twitchell et al. | |
| 7,697,885 | B2 | 4/2010 | Stoddard | |
| 7,783,246 | B2 | 8/2010 | Twitchell et al. | |
| 8,001,901 | B2 | 8/2011 | Bass | |
| 8,135,661 | B2 | 3/2012 | Olsson | |
| 8,145,119 | B2 | 3/2012 | Cornwell | |
| 8,170,467 | B2 | 5/2012 | Soddard | |
| 8,203,109 | B2 | 6/2012 | Taylor et al. | |
| 8,269,957 | B2 | 9/2012 | Saban et al. | |
| 8,301,075 | B2 | 10/2012 | Sherman et al. | |
| 8,615,190 | B2 | 12/2013 | Lu | |
| 8,903,304 | B2 | 12/2014 | Coleman et al. | |
| 8,971,441 | B2 | 3/2015 | Dowla et al. | |
| 9,071,385 | B2 | 6/2015 | Delaveau et al. | |
| 9,207,049 | B2 | 12/2015 | Rovinsky | |
| 9,404,750 | B2 | 8/2016 | Rios | |
| 2003/0058112 | A1* | 3/2003 | Gleine | B64D 45/0015 340/573.1 |
| 2005/0041728 | A1 | 2/2005 | Karlsson | |
| 2007/0063886 | A1 | 3/2007 | Brumley, II et al. | |
| 2008/0174469 | A1 | 7/2008 | Stark et al. | |
| 2009/0214205 | A1 | 8/2009 | Clark et al. | |
| 2011/0176674 | A1* | 7/2011 | Romain | H04L 9/002 380/29 |
| 2013/0015260 | A1 | 1/2013 | Schulte | |
| 2013/0023201 | A1* | 1/2013 | Coleman | H04K 3/45 455/1 |
| 2014/0147116 | A1 | 5/2014 | Krupkin | |
| 2014/0266851 | A1 | 9/2014 | Fink et al. | |
| 2015/0229434 | A1 | 8/2015 | Shawn | |
| 2015/0350914 | A1* | 12/2015 | Baxley | H04W 12/08 726/11 |

OTHER PUBLICATIONS

V1; 3G Mobile Phone Jammer; accessed from http://www.jammerfromchina.com.

V2; 3W High Power Portable All Wireless Bug Camera; accessed from http://www.jammerfromchina.com.

V3; Cell phone jammer Search by Functions; accessed from http://www.jammerfromchina.com.

V4; L5 3G Mobile Phone Signal Jammer; accessed from http://www.jammerfromchina.com.

V5; New Arrival All-in-one Handheld GPS 2G 3G 4G Mobile Phone; accessed from http://www.jammerfromchina.com.

V6; PCS_3G_WiFi_GPS Signal Blocker; accessed from http://www.jammerfromchina.com.

V7; Phone Jammer—Wholesale Jammer—DropShip From China; accessed from http://www.jammerfromchina.com.

W; Clear Sky jammers e-RAKE; accessed from http://www.hypercable.fr.

X; High Gain Directional Antennas for High Power Adjustable WiFi Phone Jammer; accessed from http://www.alljammers.com.

Y; Directional RF Jammer for blocking cellular phone calls; accessed from http://www.secintel.com.

Z; Drone jammer instruction set.

Fitriyani et al.; Yagi antenna design for signal phone jammer; 2012.

* cited by examiner

PORTABLE COUNTERMEASURE DEVICE AGAINST UNMANNED SYSTEMS

CROSS-REFERENCE TO RELATED APPLICATION

This application claims priority to U.S. Provisional Patent Application Ser. No. 62/222,475, filed Sep. 23, 2015, titled ELECTRONIC DRONE DEFENDER-WIRELESS JAMMING AND SIGNAL HACKING, the disclosure of which is incorporated by reference in its entirety herein.

BACKGROUND

The following relates generally to the electronic countermeasure arts, the unmanned autonomous vehicle arts, signal jamming arts, communications arts, satellite navigation and communication arts, law enforcement arts, military science arts, and the like. It finds particular application in conjunction with the jamming and hijacking of drones, and will be described with particular reference thereto. However, it will be understood that it also finds application in other usage scenarios and is not necessarily limited to the aforementioned application.

Unmanned or autonomous aerial vehicles ("UAV), more commonly known as "drones", have become more and more prevalent in both the military and civilian context. Current, commercially available drones embody technology that was until recently, solely within the purview of governmental entities. The drones available to the civilian and military markets include navigation systems, various types of eavesdropping components, high-definition or real-time video output, long life lithium batteries, and the like. Furthermore, current civilian models may be operated by any individual, without regarding to licensing or regulation.

The propagation of civilian drone usage has resulted in invasions of privacy, interference with official governmental operations, spying on neighbors, spying on government installations, and myriad other offensive operations. Military usage of drones, including armed drones, has increased substantially as battery storage has increased and power consumption has decreased. This widespread use of drones has led to security and privacy concerns for the military, law enforcement, and the private citizen. Furthermore, drones have substantially decreased in size, resulting in smaller and smaller, while the capabilities of the drones themselves have increased. This poses a security risk for security personnel as the operator of the drone may be far away, making the determination of the operator's intent particularly difficult to ascertain.

The drones in use typically operate using multiple frequency bands, some bands used for control signals between the drone and the operator, GPS/GLONASS signals for navigation, and other frequency bands for video and/or audio signal transmissions. This use of multiple frequencies results in difficulty in effectively tailoring a jamming signal directed solely to the offending drone, without negatively impacting other, non-offensive radio-frequency devices.

Furthermore, current commercially available jammers, while illegal in some jurisdictions, are generally omnidirectional in nature. To avoid issues relating to non-offensive devices, these jammers typically are limited in radius from less than a meter to 25 meters. Those jammers having larger effective radii for signal jamming or denial require substantial power (plug-in/non-portable) or are bulky. A common problem with all of these jammers is their inability to specifically target a drone, while allowing non-threatening devices to remain operational. Furthermore, due to the distances, and heights, at which drones operate, the portable jammers currently available lack the ability to effectively jam signals that may be used by the drones. For example, such commercially available jammers for Wi-Fi or GPS will propagate a jamming signal circularly outward, rendering the user's own devices inoperable while within that radius. The unintended consequences of such jamming may cause vehicle accidents or aircraft issues, depending upon the strength and radius of the jammer being used.

In addition to the foregoing problems, current jammers lack the ruggedness associated with field operations. That is, the commercially available jammers are delicate electronics, not designed for use by soldiers in the field. As noted above, the commercial jammers currently available further utilize multiple antennae, each directed to a different frequency band. These are not ruggedized pieces of equipment, capable of being utilized in field operations by law enforcement, security, or military. The multiple antennae are prone to breakage during transport. Those rugged military or law enforcement jammers that are available are portable in the sense that they are backpack or vehicle born devices, requiring substantial training to effectively operate.

Thus, it would be advantageous to provide a ruggedized form factor directional drone jammer that provides a soldier or law enforcement officer with simple, targeted anti-drone capabilities. Such a jammer is portable, including power supply, and comprises a rifle-like form allowing the soldier or law enforcement officer to aim via optic, electronic or open sights at a target drone for jamming of the drone control and/or GPS signals, while preventing interference for other devices utilizing the jammed frequencies.

BRIEF DESCRIPTION

The following discloses a new and improved portable countermeasure device with directional targeting which addresses the above referenced issues, and others.

In one embodiment, a portable countermeasure device is provided comprising at least one directional antenna, at least one disruption component and at least one activator.

According to another embodiment, a portable countermeasure device includes at least one of a removable power supply or an external power supply, and a body having a top portion and a bottom portion. The portable countermeasure device further includes at least one disruption component coupled to the body and in communication with the at least one removable or external power supply, and configured to generate at least one disruption signal on at least one associated frequency bands. In addition, the portable countermeasure device includes at least one activator coupled to the body and in operable communication with the at least one removable or external power supply and the disruption components, and at least one directional antenna in communication with the at least one disruption component, the at least one directional antenna removably attached to the body and configured to emit the at least one disruption signal generated by the at least one disruption component.

In another aspect, the portable countermeasure device further comprises a firearm form factor body, wherein the directional antenna is affixed to a front portion of the firearm form factor body. The one or more disruption components may be externally or internally mounted to the firearm form factor body.

In another aspect, a battery pack is capable of being inserted into an appropriate location on the firearm form factor body so as to supply power to the disruption components. Such a battery pack may comprise a lithium-ion battery, NiMH battery, or the like.

In another aspect, an external power supply may supply power to the disruption components.

In still another aspect, a set of sights is coupled to the firearm form factor body, allowing aiming of the disruption components on a targeted drone.

In yet another aspect, the disruption components generate disruptive signals across multiple frequency bands via at least one antenna. In some embodiments, the multiple frequency bands include GPS, control signals, and/or Wi-Fi signals. In other embodiments, multiple antennae are used for different frequency bands.

BRIEF DESCRIPTION OF THE DRAWINGS

The subject disclosure may take form in various components and arrangements of component, and in various steps and arrangement of steps. The drawings are only for purposes of illustrating the preferred embodiments and are not to be construed as limiting the subject disclosure.

DETAILED DESCRIPTION

Figure 1:
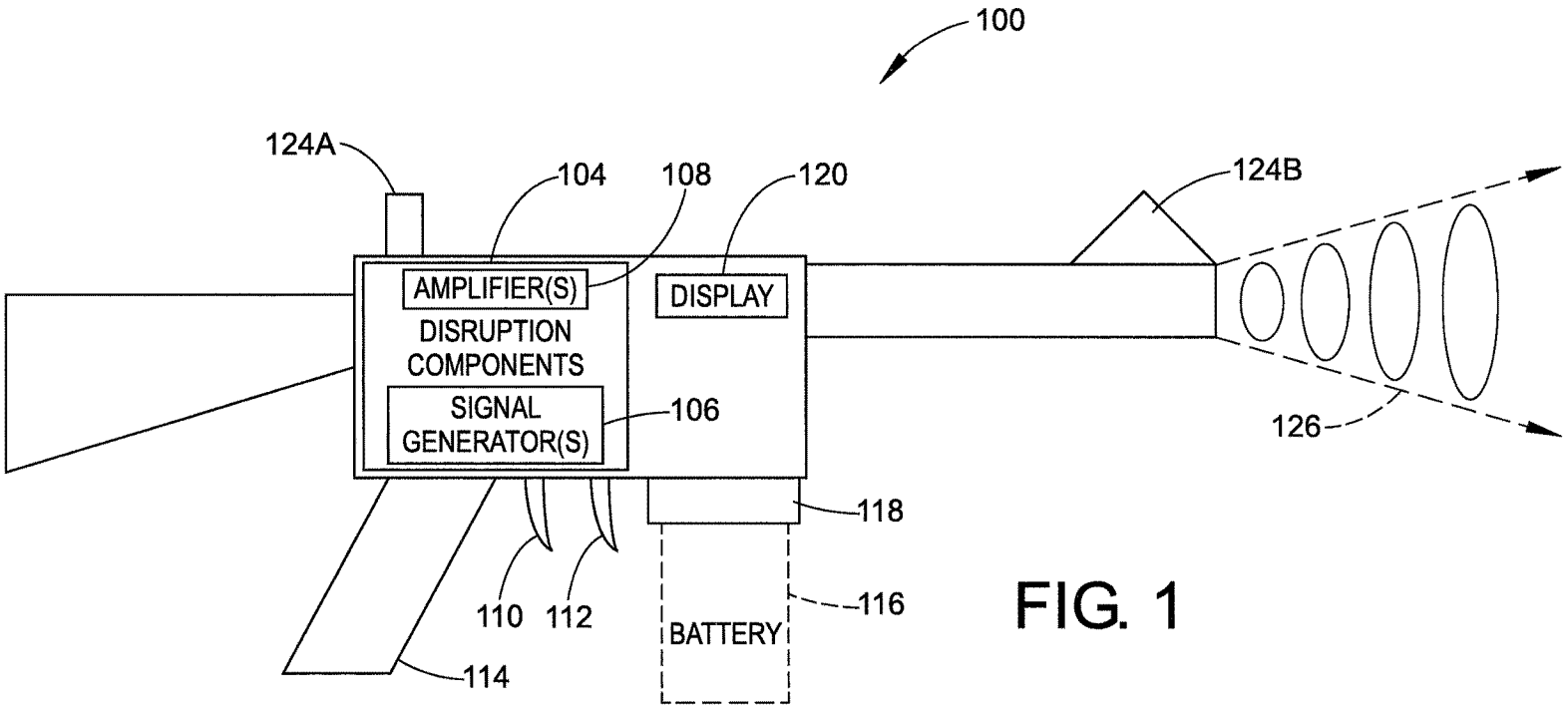
FIG. 1 illustrates a functional block diagram of a portable countermeasure device in accordance with one aspect of the exemplary embodiment.

One or more embodiments will now be described with reference to the attached drawings, wherein like reference numerals are used to refer to like elements throughout. Aspects of exemplary embodiments related to systems and methods for signal jamming and signal hijacking are described herein. In addition, example embodiments are presented hereinafter referring to a rifle-like apparatus that may be aimed by a soldier or law enforcement officer on a drone to disrupt control and/or navigation of the drone, however application of the systems and methods set forth can be made to other areas utilizing electronic countermeasures and privacy protection.

As described herein, there is described a portable countermeasure device, such as rifle-like or firearm form factor jammer, that can be aimed by a user at a drone, resulting in the disruption of control and/or navigation signals. In one embodiment, the portable countermeasure device includes multiple signal generators and associated amplifiers, producing disruptive, spoofing and/or jamming signals across multiple frequency bands. It will be appreciated by those skilled in the art that suitable disruptive signals may include, for example and without limitation, multi- or single frequency noise signals, alternative command signals, false data signals, and the like. In such an embodiment, a single antenna is coupled to the portable countermeasure device, capable of directing multiple frequency bands of disruptive signals toward a single target, forming a cone around the target. The portable countermeasure device may be self-contained, with replaceable battery packs, or receive power from an external source.

It will be appreciated that the various components of the portable countermeasure device, as described in greater detail below, may be added to an existing fire arm, an aftermarket rifle stock, or a firearm-like form factor having a customized body incorporating the various components. The portable countermeasure device may be aimed via iron sights, optical scope, or other means for directing the disruptive signals toward a targeted drone. Furthermore, the embodiments disclosed herein may be implemented without software, hardware, or other signal analysis means, enabling a soldier or law enforcement officer to use the portable countermeasure device without substantial training. Such a simplified implementation further ruggedizes the portable countermeasure device for use in harsh environments where weather, lack of resupply, insurgents, criminals, or the like, may operate.

Referring now to FIG. 1, there is shown a functional block diagram of a portable countermeasure device 100 in accordance with one exemplary embodiment of the subject application. As illustrated in FIG. 1, the portable countermeasure device 100 may be implemented in a firearm-like form factor, providing ease of use and familiarization with the user. Accordingly, the portable countermeasure device 100 provides a soldier or law enforcement officer with the ability to specifically target a particular drone with disruptive signals, while minimizing the impact of the generated signal on other, non-targeted devices. It will be appreciated that the various components depicted in FIG. 1 are for purposes of illustrating aspects of the exemplary hardware are capable of being substituted therein.

It will be appreciated that the portable countermeasure device 100 of FIG. 1 is capable of implementation in a variety of handheld or portable form factors, and the illustrations depicted and discussed hereinafter provide exemplary, and non-limiting, form factors contemplated hereunder. As shown in FIG. 1, the portable countermeasure device 100 comprises a body 102 including signal disruption components 104, e.g., at least one signal generator 106 and at least one amplifier 108. It will be appreciated that the body 102 may, for example and without limitation, resemble a commonly used rifle, including, without limitation, M4 carbine, M14, AR-platform, or the like, comprising an upper receiver and a lower receiver, as well as other rifle designs, as will be appreciated by those skilled in the art including, for example, modular rifle designs, standard rifle designs, and the like. Depending upon the configuration of the portable countermeasure device 100, the signal disruption components 104 may be contained in the upper receiver, the lower receiver, or both.

The body 102 may be constructed of non-metallic materials, i.e., ballistic plastic, carbon fiber, ceramics, etc., or suitable non-transmissive metallic composites. The body 102 may be implemented in a suitable form factor with which soldiers and/or law enforcement personnel are already familiar, e.g., the aforementioned M4 carbine, AR-platform, AK-platform, SCAR, bullpup, etc. It will be appreciated that the width, length, and height of the body 102 may be dependent upon the size and number of generators 106 and amplifiers 108 either integral therein or externally affixed thereto. According to one embodiment, a multifunctional cell is formed as the body 102 to provide both structural support/shape of the portable countermeasure device 100 as well as supply power to the components therein. A suitable example of such a multifunctional cell is provided in PCT/US2013/040149, filed May 8, 2013 and titled MULTI-FUNCTIONAL CELL FOR STRUCTURAL APPLICATIONS, the entire disclosure of which is incorporated by reference herein. In accordance with another embodiment, the portable countermeasure device 100 may include multiple signal disruption components 104 to combat a variety of potential targets, e.g., receivers of improvised explosive devices (IEDs), commercial drones, military drones, or other portable electronic devices of enemy combatants or suspects, e.g., cellular phones, GPS/Satellite-based navigation devices, remote control detonators, etc.

The portable countermeasure device 100, as shown in FIG. 1, includes a first activator 110, and a second activator 112, which are located adjacent to a pistol grip 114 on underside of the body 102. It will be understood that the portable countermeasure device 100 may be implemented with a single activator, whereby multiple disruptive signals are generated via the activation of the single activator. The activators 110-112, as will be appreciated, is operable to close a circuit or "firing mechanism" (not shown) to allow power to flow from the power source, e.g., backpack (not shown), AC power (not shown), or optional, battery pack 116 (shown in dashed lines), to the signal generator 106 and amplifier 108 of the signal disruption components 104. It will be appreciated that the activators 110-112 may be implemented as typical firearm triggers, toggle switches, spring-loaded buttons, or the like. According to one embodiment, the first activator 110 is operable to activate control circuitry for disruption of control frequency bands, while the second activator 112 is operable to activate control circuitry for disruption of GPS/navigation bands. An example implementation of the dual activators 110-112 is embodied in the portable countermeasure device 200 of FIG. 2, discussed below.

In accordance with one embodiment, the signal generator 106 and corresponding amplifier 108, may be configured to generate signals from DC to 30 GHz. In another embodiment, a signal generator 106, with corresponding amplifier 108, is incorporated to generate disruptive signals in the 800-900 MHz, 1000 MHz-1.8 GHz, and 2.0 GHz-2.6 GHz frequency ranges, or other known control/navigation signal frequency ranges. In one particular embodiment, a signal generator 106 for each of the 900 MHz frequency band, the 1.2 GHz frequency band, the 1.5 GHz frequency band, and the 2.4 GHz frequency band, with corresponding amplifiers 108 are incorporated into the portable countermeasure device 100. Additionally, the signal generator 106 may be in communication with memory (not shown) that stores alternative command signals for spoofing or hacking, as will be known in the art, a particular control frequency. In such embodiments, the signal generator 106 may be operable to transmit a different navigation signal (altering the coordinates the drone is receiving from navigation satellites/commands), transmit a control signal indicating the drone should land or return to home, or the like. It will be appreciated that such signals generated via the signal generator 106 may be output in addition to noise, jamming, or the like, or in place thereof.

In accordance with the example embodiment of FIG. 1, the optional battery pack 116 supplies suitable power to the disruptions components 104 of the portable countermeasure device 100. In one non-limiting example, the battery pack 116 may be implemented as a rechargeable battery, including, for example and without limitation, a lithium-ion battery, a lithium ion polymer battery, a nickel-metal hydride battery, lead-acid battery, nickel-cadmium cell battery, or other suitable, high-capacity source of power. In other embodiments, a non-rechargeable battery may be utilized, as will be appreciated by those skilled in the art. According to one exemplary embodiment, the battery pack 116 is implemented in a magazine form factor, capable of insertion into a battery well 118 (similar to the magazine well of the lower receiver of a rifle). It will be appreciated that such an implementation will be natural to a soldier or law enforcement officer, allowing utilization of existing magazine carrying devices for carrying additional battery packs 116, familiarity with changing a battery pack 116, as well as maintain the balance of the portable countermeasure device 100 similar to those rifles with which the soldier or law enforcement officer is most familiar. In accordance with another embodiment, the portable countermeasure device 100 may utilize an auxiliary cable to a backpack power supply, a remote power source, a portable generator, fuel cell, vehicle interface, or the like. Furthermore, the skilled artisan will appreciate that the battery pack 116 is not limited in form and can be complementary to the form-factor of the portable countermeasure device 100, for example, similar to a rectangular magazine, tubular magazine, and the like, as well as being integrated within the body 102 of the portable countermeasure device 100, i.e., a structural battery as discussed above.

According to another embodiment, the portable countermeasure device 100 may include a display 120 operable to display remaining power levels of the battery pack 116, effective range of the output of the signal disruption components 104 relative to power supply level, or the like. This optional display 120 may be connected to control components (not shown), and be customized to display the frequency selected for output by the jammer components 104. In such an embodiment, the display 120 may be implemented as an LED, LCD, OLED, or other suitable display type.

Figure 2:
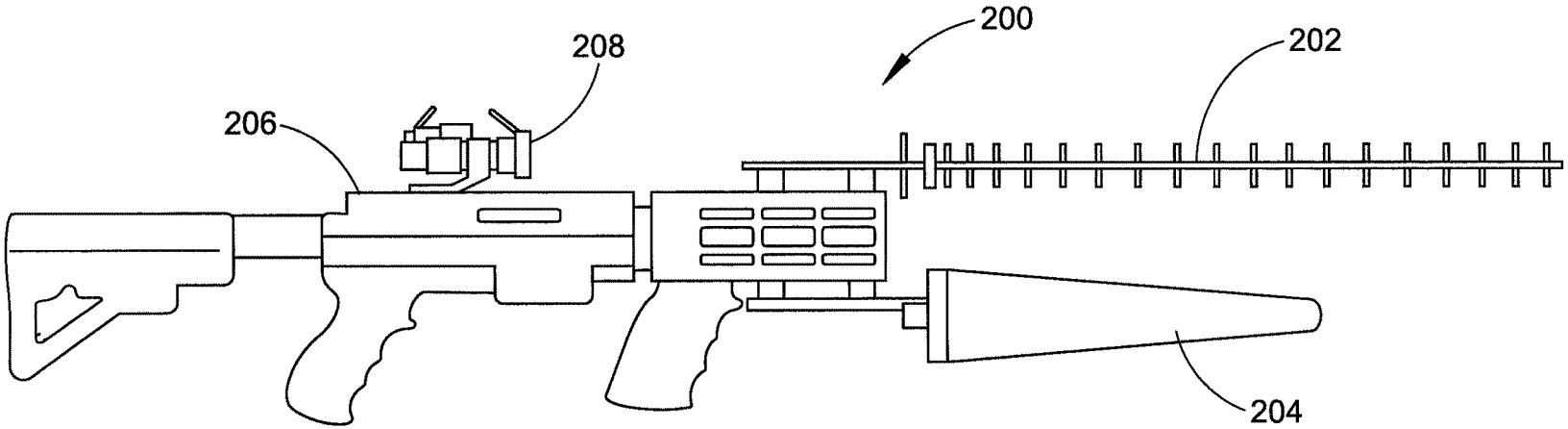
FIG. 2 illustrates an example portable countermeasure device according to one embodiment of the subject application.

The portable countermeasure device 100 depicted in FIG. 1 utilizes a single, multi-function directional antenna 122, extending outward from the body 102 in a direction away from the user. It will be understood that other embodiments, as discussed below, may utilize multiple directional antennae in accordance with the number of disruptive signals to be generated, the types of disruptive signals, desired range, and the like, as illustrated in FIG. 2, described below. It will be appreciated that, maintaining a suitable comparison to a rifle, the antenna 122 replaces the barrel of a rifle, thereby maintaining familiarity and ease of operation by the soldier or law enforcement officer. In accordance with some embodiments, the antenna 122 may be "hot-swappable" or "replaceable" in the field, allowing for different directional antennae to be used by the portable countermeasure device 100 in accordance with the battlefield conditions. For example, the distances involved in commercial drone disruption may utilize less power-intensive disruptive signals than military drone disruption. In such an embodiment, a suitable antenna may not need to be as large, or a different design antenna may be used. In another example, in the event that the antenna 122 is damaged while in the field, an expedient repair capable of being performed by the soldier or law enforcement officer is replacement of the antenna 122, as opposed to having to submit the portable countermeasure device 100 to an armorer or electronics specialist for repair, thereby keeping the portable countermeasure device 100 operative.

In one particular embodiment, the antenna 122 is implemented as a combined, high-gain, directional antenna having a helical cross-section. Other suitable directional antenna, e.g., Yagi, cylindrical, parabolic, long period array, spiral, etc., are also capable of being utilized in accordance with the disclosure set forth herein.

Affixed to the top of the body 102, either fixed thereto, or removably attached, e.g., rail attachments, are "iron sights" 124A (with a corresponding sight 124B attached or fixed to the end of the antenna 122), allowing for aiming by the soldier or law enforcement officer of the portable countermeasure device 100 at a target drone. In other embodiments, particularly when the top of the body 102 includes the aforementioned rails, a wide or narrow field of view optical sight may be utilized to allow the soldier or law enforcement officer to target drones beyond the normal field of vision. To avoid unintentional disruption of nearby devices outside the disruption cone 126 directed by the antenna, the sight 124A and/or 124B may be constructed of a suitable non-metallic material. The disruption cone 126 may range from 0 degrees to 180 degrees, including for example and without limitation, 0 to 120 degrees, 0 to 90 degrees, 0-45 degrees, 20 to 30 degrees or variations thereof. The effective range of the portable countermeasure device 100 may extend outward from the antenna 122 at varying ranges, from 0 meters outward greater than or equal to 400 meters in accordance with the power supplied to the disruption components 104. Accordingly, it will be appreciated by those skilled in the art that the maximum range of the portable countermeasure device 100 may be extended or reduced in accordance with the amount of power supplied to the disruption components 104, the ratio of power to time on target, and the like.

In operation, the soldier or law enforcement officer will target a drone hovering or flying in an unauthorized area by aiming the antenna 122 of the portable countermeasure device 100 in a manner similar to a regular firearm. That is, the soldier or law enforcement officer, using the iron sights or optical sights 208, directs the antenna 122 of the portable countermeasure device 100 toward the drone. After ensuring that sufficient power is available, and the drone is within the effective range of the portable countermeasure device 100, the soldier or law enforcement officer activates the activator 110 (for all control frequency bands) and/or the activator 112 (for all GPS/navigation frequency bands) to activate the control circuit (not shown), which regulates the power from the battery 116 (or other power source) to the disruption components 104. In an alternative embodiment, a single activator (not shown) may control activation of all disruption components 104, thereupon simultaneously or sequentially generating disruptions signals as described herein when the activators 110 and 112 are activated. When disrupting multiple frequency bands, e.g., control signals, Wi-Fi and/or GPS, multiple disruption signal generators 106 and amplifiers 108 are activated to produce the desired disruption signal, e.g., noise, spoofing, alternate commands, alternate coordinates, etc., on the selected frequency bands. The disruptive signal is then directed through the single antenna 122 (capable of handling multiple frequency bands) or multiple antennae toward the drone at which the portable countermeasure device 100 is aimed. The disruption cone 126 then extends outward from the portable countermeasure device 100 toward the drone, disrupting control and GPS signals effectively negating the presence of the drone in the unauthorized area. Alternative embodiments disclosed herein include generating, via the signal generator 106, alternative commands to the drone, instructing the drone to land, change direction, change video broadcast stream, stop video streaming/recording, thereby overriding the original control signals. Furthermore, the portable countermeasure device 100 may be configured to transmit altered navigation coordinates, confusing the drone or forcing the drone to leave (or travel to) a particular area. The soldier or law enforcement officer then maintains his/her aim on the drone until the drone falls, retreats, loses power, or the like. The activator(s) 110-112 may then be deactivated by the law enforcement officer or soldier and the disabled drone may then be recovered by the appropriate authority for determination of the owner.

According to one example embodiment, the portable countermeasure device 100 includes hardware, software, and/or any suitable combination thereof, configured to interact with an associated user, a networked device, networked storage, remote devices, detector systems, tracking systems, and the like. In such an example embodiment, the portable countermeasure device 100 may include a processor, which performs signal analysis, ballistic analysis, or the like, as well as execution of processing instructions which are stored in memory connected to the processor for determining appropriate signal generation for disruption, power supply management, and the like. It will be appreciated that the inclusion of a suitable processor is optional, depending upon the ruggedness of the underlying implementation of the portable countermeasure device 100. Further, it will be understood that separate, integrated control circuitry, or the like, may be incorporated into the portable countermeasure device 100 so as to avoid interference of operations by the disruption components 104, or the like.

According to another example embodiment, the portable countermeasure device 100 may include a selector control (not shown), which may be located on the exterior of the portable countermeasure device 100. Such a selector control may be operable to select a frequency or frequencies to be generated by the at least one signal generator and amplified by the corresponding at least one amplifier 108. In accordance with one alternate embodiment, a variable amplifier may be used, whereupon power supplied to the signal generators 106 is modified, without increasing the power drain of the portable countermeasure device 100. It will be appreciated that the selector control may be implemented to provide ease of use to the soldier or law enforcement official in the field to reflect the desired target of the portable countermeasure device 100.

FIG. 2 provides an example of a dual antenna (202 and 204) implementation of a portable countermeasure device 200 according to one embodiment of the subject disclosure. As shown in FIG. 2, the portable countermeasure device 200 instead of utilizing an existing firearm, utilizes a suitable firearm-like form factor body r 206 to which the various components are attached, e.g., an aftermarket or custom rifle stock. An optical sight 208 is included on an upper rail of the firearm-like form factor body 206. In this embodiment, the disruption components (not shown) are inserted within the firearm-like form factor body 206 in place of the standard firearm components, e.g., the receiver(s) and barrel. This reduces the cost of implementation of the subject disclosure, while preserving the familiarity with a common weapon for the soldier and/or law enforcement personnel.

Figure 3:
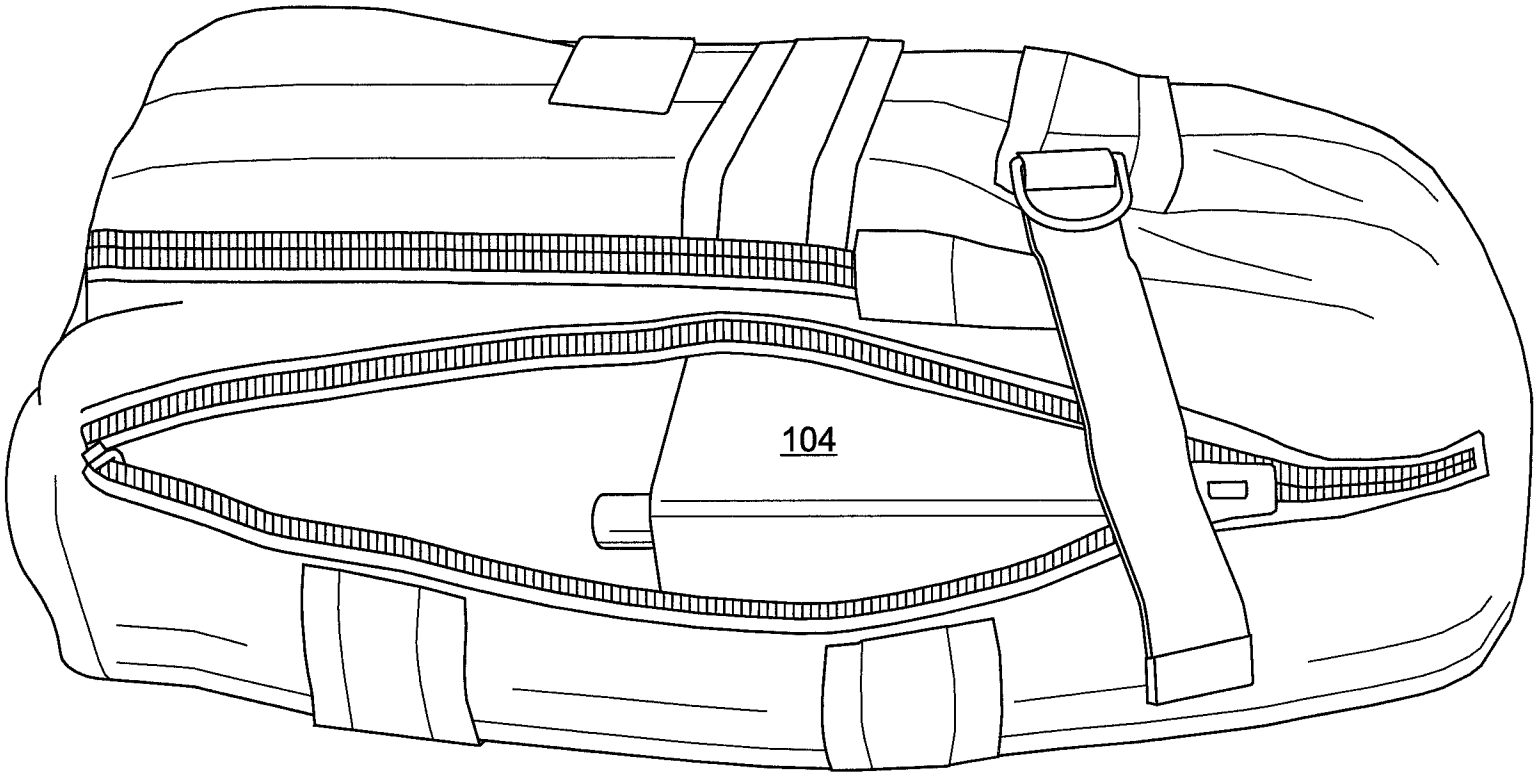
FIG. 3 illustrates an external backpack containing the jammer components utilized by the example portable countermeasure device of FIG. 2.
Figure 4:
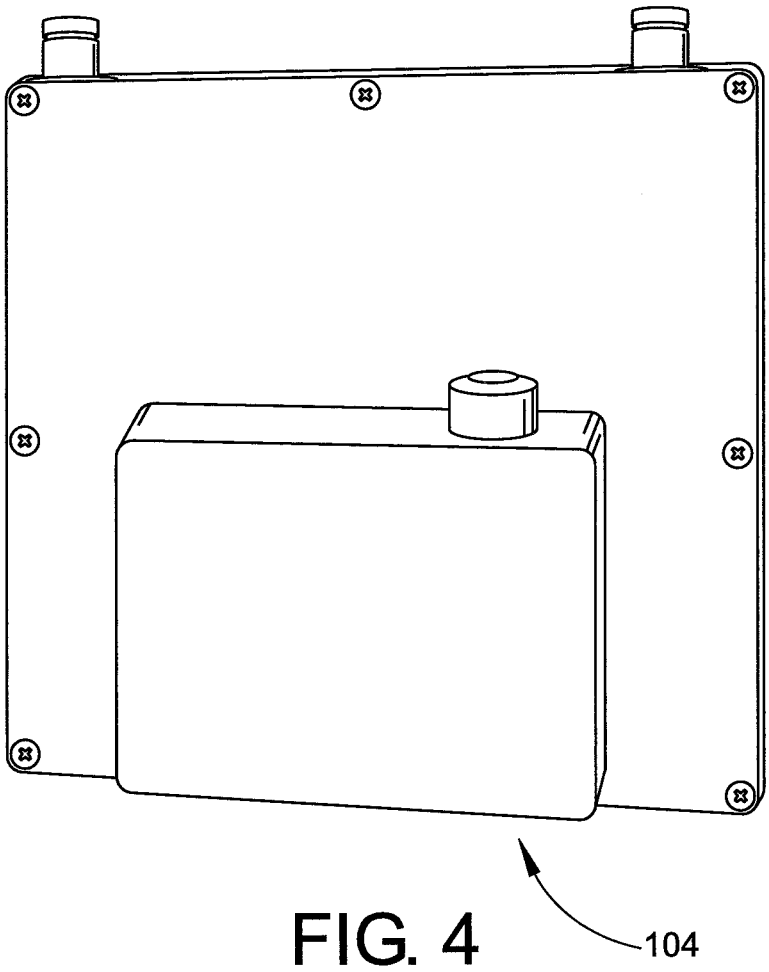
FIG. 4 illustrates a close up view of jammer components utilized by the portable countermeasure device of the example embodiment of FIG. 2.
Figure 5:
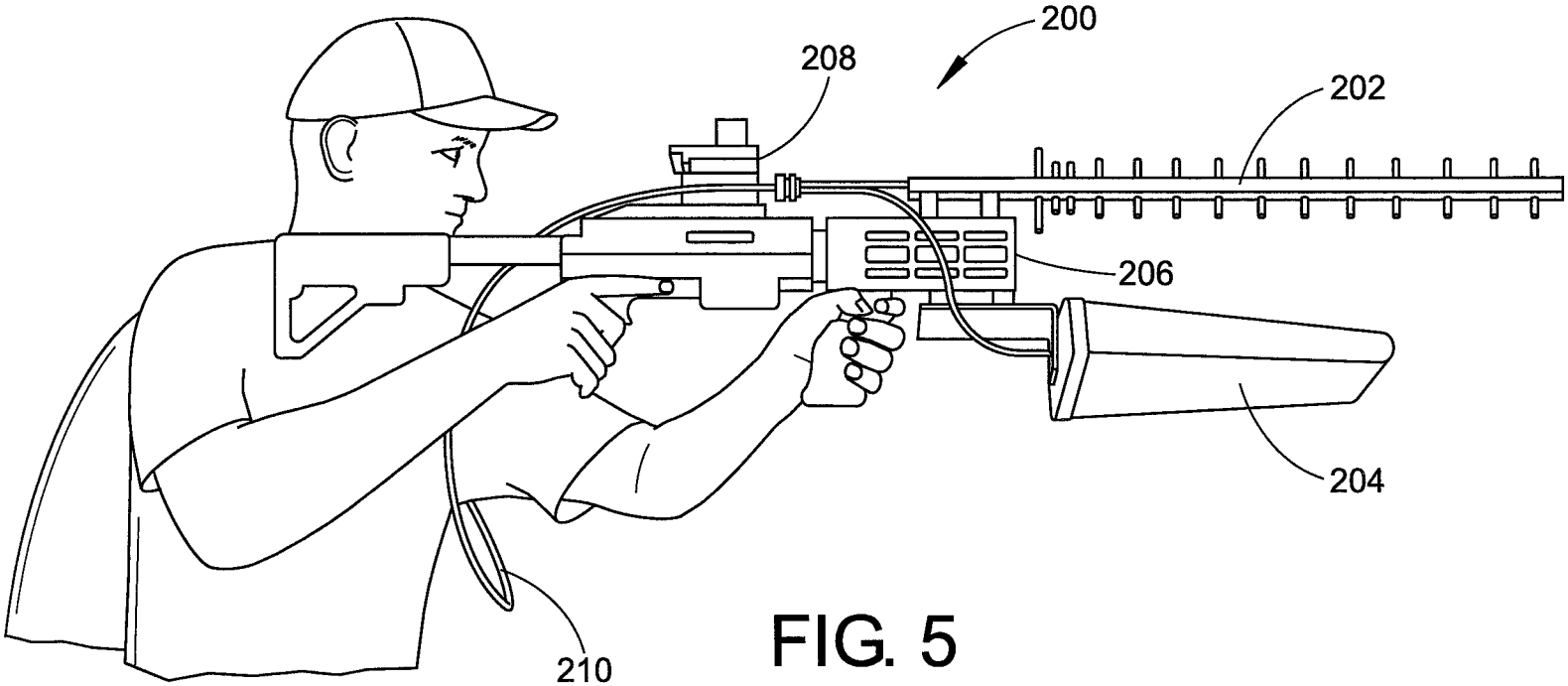
FIG. 5 illustrates a photograph of the portable countermeasure device of FIG. 2 in use in accordance with one aspect of the exemplary embodiment.
Figure 6:
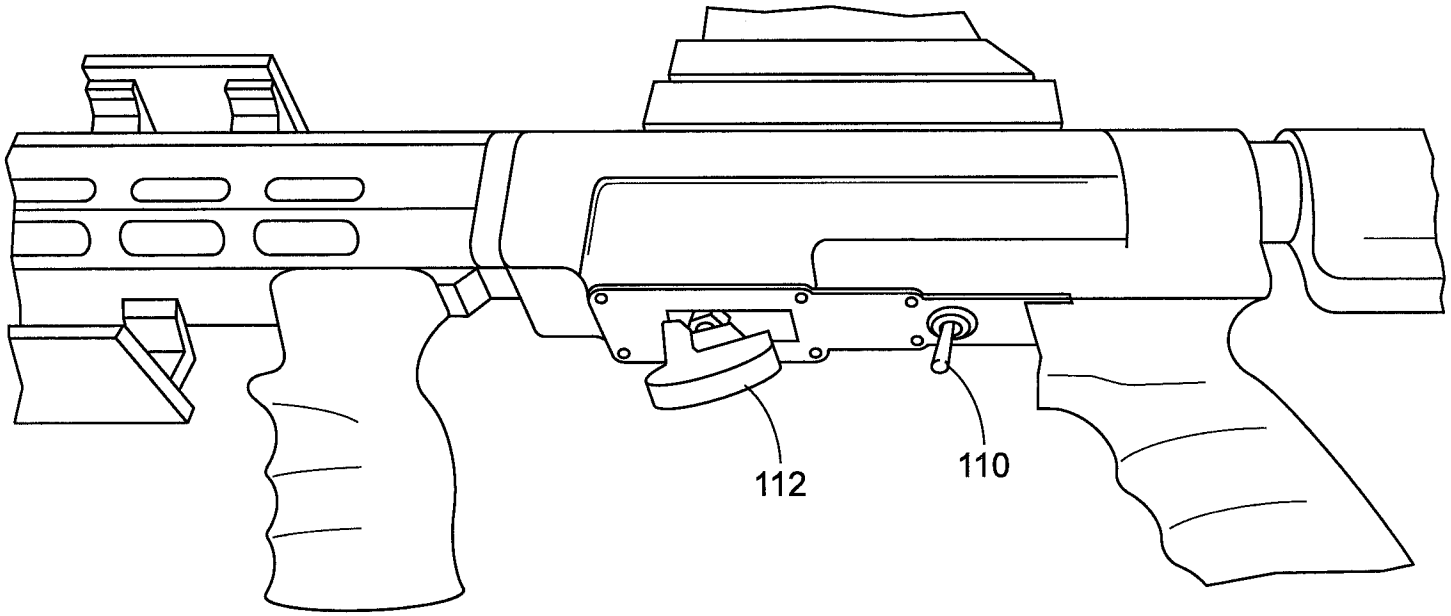
FIG. 6 illustrates a close-up view of the activators of the portable countermeasure device of FIG. 2 in accordance with one aspect of the exemplary embodiment.
Figure 7:
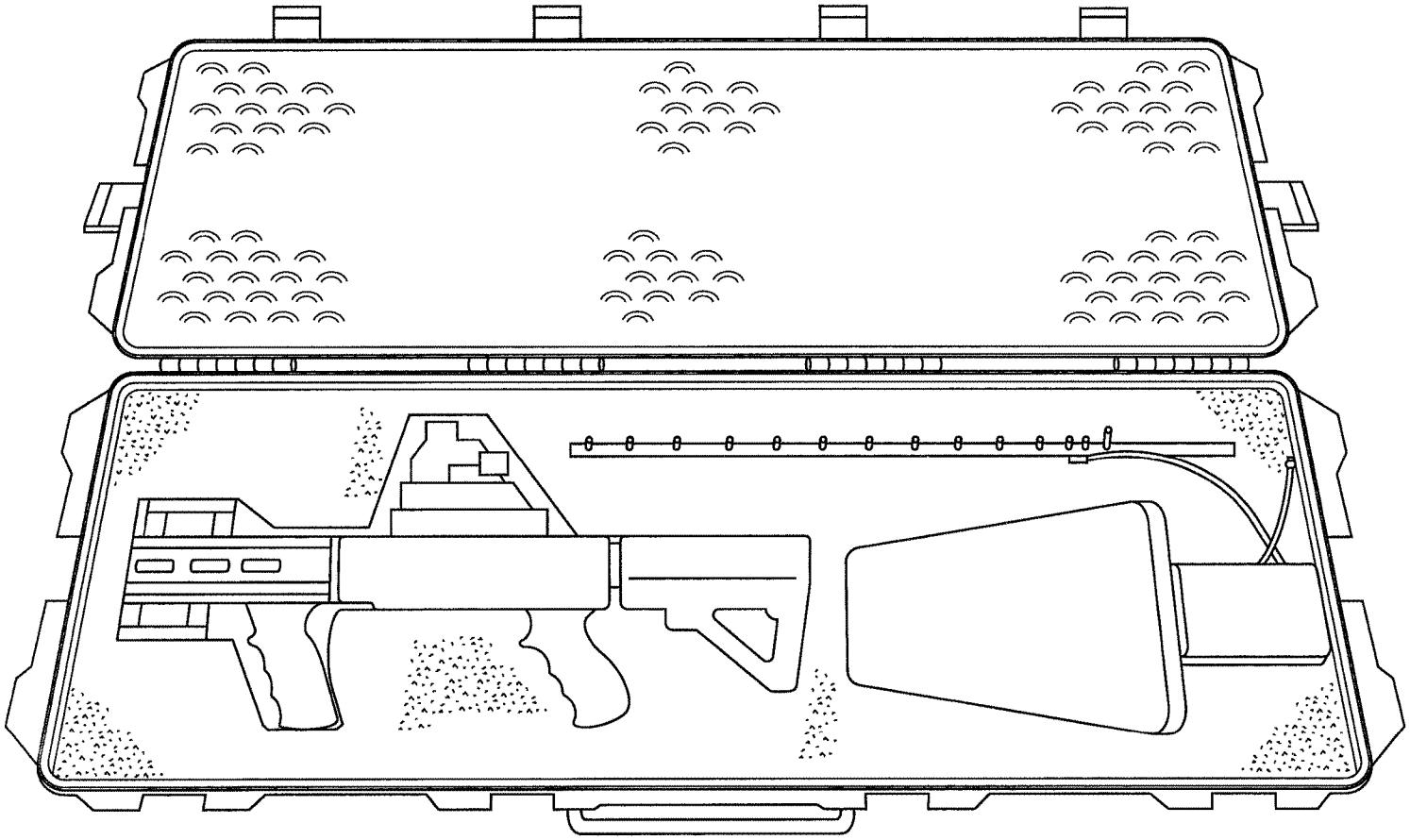
FIG. 7 illustrates the example portable countermeasure device of FIG. 2 broken down for transport in accordance with one embodiment of the subject application.

The embodiment of FIG. 2 utilizes disruption components 104 located external to the body 206 of the portable countermeasure device 200. Accordingly, FIGS. 3 and 4 depict one example implementation of the portable countermeasure device 100, wherein the electronics, i.e., disruption components 104, are located external to the portable countermeasure device 100, i.e., contained within a backpack and coupled to the device via wired connection 210, as shown in FIG. 5. The portable countermeasure device 200 of FIGS. 2-5 utilizes dual activators 110 and 112 for respective disruption of control signals and GPS/navigation signals. FIG. 6 provides a close-up view of an example implementation of the dual activators 110 and 112 on the portable countermeasure device 200. The ruggedness and portability of the portable countermeasure device 200 are further exemplified in the photograph of FIG. 7, wherein the portable countermeasure device 200 is modular in nature, capable of being transported by a soldier or law enforcement official without damage to the antenna 202-204, the body 206, optics 208 and disruption components (not shown) stored in the backpack depicted in FIG. 4.

Figure 8:
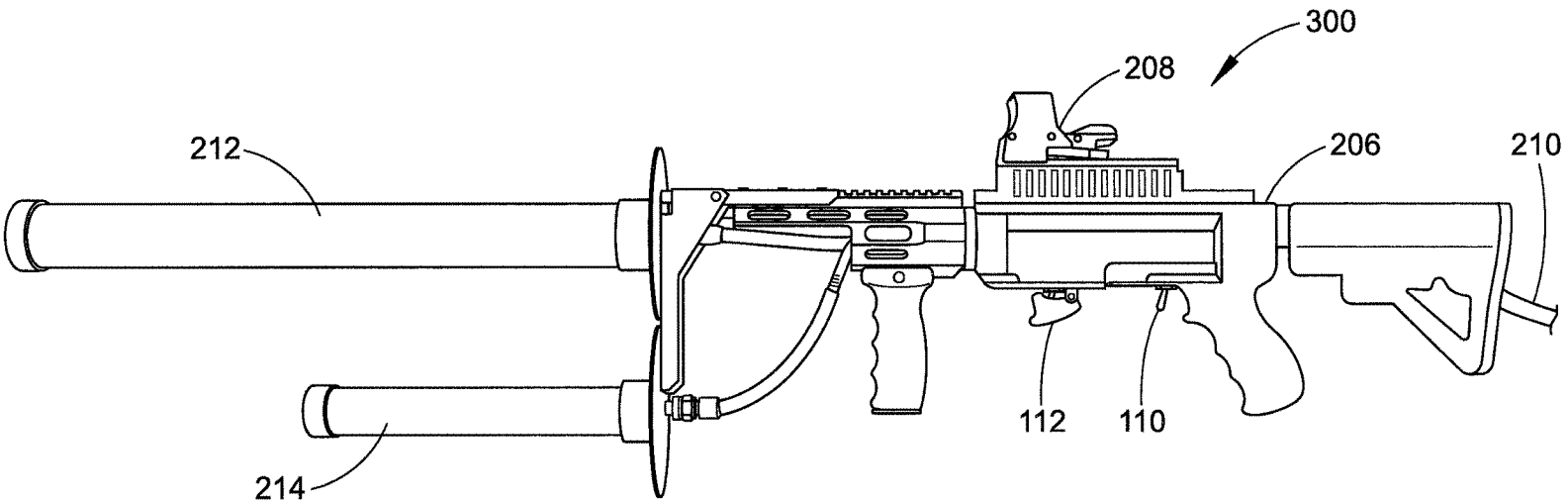
FIG. 8 illustrates the example portable countermeasure device of FIG. 2, wherein different antenna shapes are utilized in accordance with one embodiment of the subject application.

FIG. 8 provides another illustration of the dual antennae embodiment of the portable countermeasure device 300 of FIG. 2. As illustrated in FIG. 8, the portable countermeasure device 300 replaces the antennae 202 and 204 shown in the portable countermeasure device 200 of FIG. 2 with antennae 212 and 214. It will be appreciated that the antennae 212 and 214 may function similarly to the antennae 202 and 204 of FIG. 2, e.g., transmit on the same frequency bands or transmit on different bands, as discussed above. Furthermore, the antennae 212 and 214 illustrate a weatherized and ruggedized version of the antennae 202 and 214. It will be understood that while the appearance of the portable countermeasure device 300 of FIG. 8 differs from the illustration of FIG. 2 and FIG. 5, the functioning thereof, as well as the disruption components 104 (not shown) are the same.

Figure 9:
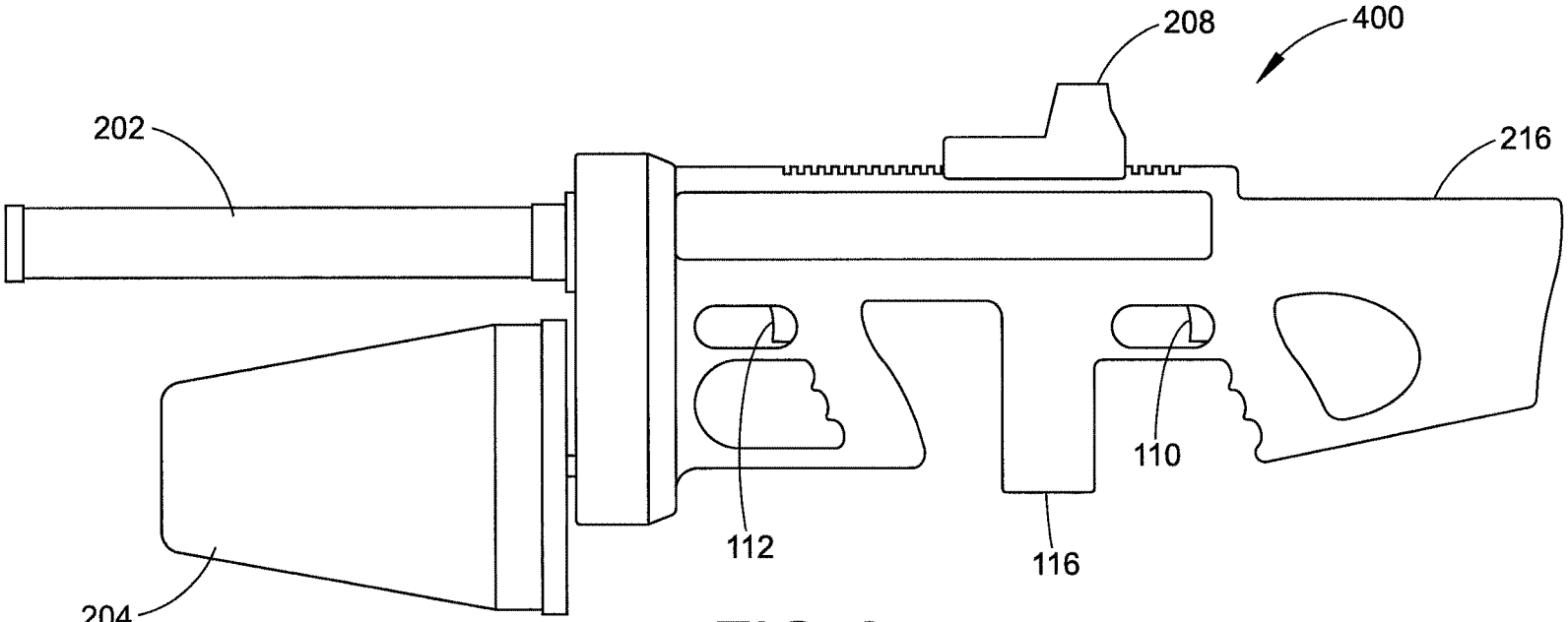
FIG. 9 illustrates an example portable countermeasure device utilizing dual antennae in accordance with another embodiment of the subject application.

Similarly, FIG. 9 illustrates yet another implementation of the portable countermeasure device 400 depicted in FIGS. 1 and 2. As shown in FIG. 9, the antenna 202 and 204 are represented in different form factors, as generally illustrated by the customized body 216 of the portable countermeasure device 400. As shown in FIG. 9, the body 216 incorporates a replaceable battery 116, dual activators 110 and 112, and sight 208, as described in detail above. It will be understood that the example implementations of FIGS. 1-9 are non-limiting examples of possible firearm-like form factors implemented as the portable countermeasure device 100 according to the disclosures contained herein.

It is to be appreciated that in connection with the particular illustrative embodiments presented herein certain structural and/or function features are described as being incorporated in defined elements and/or components. However, it is contemplated that these features may, to the same or similar benefit, also likewise be incorporated in other elements and/or components where appropriate. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

It is also to be appreciated that particular elements or components described herein may have their functionality suitably implemented via hardware, software, firmware or a combination thereof. Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

In short, the present specification has been set forth with reference to preferred embodiments. Obviously, modifications and alterations will occur to others upon reading and understanding the present specification. It is intended that the invention be construed as including all such modifications and alterations insofar as they come within the scope of the appended claims or the equivalents thereof. That is to say, it will be appreciated that various of the above-disclosed and other features and functions, or alternatives thereof, may be desirably combined into many other different systems or applications, and also that various presently unforeseen or unanticipated alternatives, modifications, variations or improvements therein may be subsequently made by those skilled in the art which are similarly intended to be encompassed by the following claims.

What is claimed is:

1. A portable countermeasure device, comprising:

at least one directional antenna;

at least one signal disruption component in electronic communication with the at least one directional antenna;

at least one activator communicatively coupled to the at least one signal disruption component; and a firearm form factor body having a top portion, a bottom portion, a first side, a second side, a front, and a back, wherein the at least one signal disruption component is disposed therein.

2. The portable countermeasure device of claim 1, wherein the at least one signal disruption component further comprises:

at least one signal generator; and at least one amplifier coupled to the at least one signal generator, wherein the at least one signal generator is configured to generate a disruptive signal on an associated frequency band and the corresponding at least one amplifier amplifies the generated disruptive signal.

3. The portable countermeasure device of claim 2, wherein the at least one directional antenna is selected from the group consisting of a helical antenna, a Yagi antenna, a cylindrical antenna, or a parabolic antenna.

4. The portable countermeasure device of claim 3, wherein the at least one directional antenna is removably attached to the body, the at least one directional antenna extending outward therefrom.

5. The portable countermeasure device of claim 4, further comprising a power source selected from the group comprising a battery pack or an external power supply.

6. The portable countermeasure device of claim 5, wherein the body is a firearm form factor body, further comprising a battery well configured to receive a removable battery pack, the removable battery pack supplying power to the at least one jamming component.

7. The portable countermeasure device of claim 6, further comprising at least one sight, the at least one sight removably coupled to the top portion of the body.

8. The portable countermeasure device of claim 7, further comprising a selector control, the selector control in communication with the at least one signal disruption component and operable to select one or more frequency bands in which a signal is generated.

9. The portable countermeasure device of claim 8, wherein the at least one disruption component generates disruption signals on GPS, control and/or Wi-Fi frequencies.

10. The portable countermeasure device of claim 9, wherein disruption signals include at least one of noise, spoofing, or alternate control commands.

11. The portable countermeasure device of claim 9, wherein the at least one directional antenna is configured to transmit each generated disruption signal simultaneously at a drone.

12. A portable countermeasure device, comprising:

at least one of a removable power supply or an external power supply;

a firearm form factor body having a top portion and a bottom portion;

at least one disruption component disposed within the body and in communication with the at least one removable or external power supply, and configured to generate at least one disruption signal on at least one associated frequency bands;

at least one activator coupled to the body and in operable communication with the at least one removable or external power supply and the disruption components; and at least one directional antenna in communication with the at least one disruption component, the at least one directional antenna removably attached to the body and configured to emit the at least one disruption signal generated by the at least one disruption component.

13. The portable countermeasure device of claim 12, wherein the at least one disruption component further comprises at least one signal generator and at least one corresponding amplifier, the at least one signal generator and corresponding at least one amplifier being operatively coupled to the at least one removable or external power supply and configured to generate the at least one disruption signal on the at least one frequency band.

14. The portable countermeasure device of claim 13, wherein the body further comprises a battery well located adjacent the at least one activator on the bottom portion of the body, the battery well configured to receive a removable battery pack supplying power to the at least one disruption component.

15. The portable countermeasure device of claim 14, further comprising at least one sight affixed to a top portion of the body.

16. The portable countermeasure device of claim 14, wherein the at least one frequency band corresponds to navigation, control, Wi-Fi, GPS, and Bluetooth frequency bands.

17. The portable countermeasure device of claim 16, further comprising a selector control on a first side of the body, the selector control operable to control activation of the at least one disruption component responsive to an activation of the activator.

18. The portable countermeasure device of claim 12, wherein the at least one disruption signal comprises at least one of a noise signal, a spoofing signal, or alternate control command signal.

* * * * *